US005639085A

United States Patent [19]

Feeney et al.

[11] Patent Number: 5,639,085

[45] Date of Patent: Jun. 17, 1997

[54] LIGHT WEIGHT, SOFT FEEL HAND BALL

[75] Inventors: Brian P. Feeney, Enfield, Conn.; R. Dennis Nesbitt, Westfield, Mass.

[73] Assignee: Lisco, Inc., Tampa, Fla.

[21] Appl. No.: 526,674

[22] Filed: Sep. 11, 1995

[51] Int. Cl.[6] ..... A63B 37/06

[52] U.S. Cl. ..... 473/609

[58] Field of Search ..... 273/58 R, 58 A, 273/58 B, 58 BD, 61 C, 65 R, 65 B, 65 E, 65 ED, 65 EE, 58 C, 58 J, 58 K

[56] References Cited

U.S. PATENT DOCUMENTS

| | | | |
|---|---|---|---|
| 2,952,460 | 6/1960 | Ellis | 273/58 |
| 3,185,476 | 5/1965 | Fechner | 273/58 |
| 3,980,300 | 9/1976 | Hornsby, Jr. | 273/58 B |
| 4,093,219 | 6/1978 | Piraud | 273/65 B |
| 4,154,789 | 5/1979 | Delacoste | 264/138 |
| 4,187,134 | 2/1980 | Svub et al. | 156/170 |
| 4,944,363 | 7/1990 | Osher et al. | 273/58 A |
| 4,947,466 | 8/1990 | Horiuchi et al. | 273/61 C |
| 5,026,054 | 6/1991 | Osher et al. | 273/58 A |
| 5,460,367 | 10/1995 | Horiuchi | 273/61 C |

*Primary Examiner*—Steven B. Wong

[57] ABSTRACT

A ball comprising a hollow sphere which has an inner diameter of about 1.23 inches and an outer diameter of about 1.88 inches and a thickness of about 0.325 inches. The sphere is fabricated of an elastomeric material weighing between about 50 and 60 grams, and a compression between about 0.170 and 0.220 and a drop rebound of about 50–53 inches.

11 Claims, 1 Drawing Sheet

LIGHT WEIGHT, SOFT FEEL HAND BALL

BACKGROUND OF THE INVENTION

1. Field of the Invention

The present invention relates to a light weight, soft feel hand ball and more particularly pertains to a ball which is lighter in weight than normal and of a softer feel for making the game of hand ball more enjoyable.

2. Description of the Prior Art

The use of resilient balls of various designs and configurations is known in the prior art. More specifically, resilient balls of various designs and configurations heretofore devised and utilized for the purpose of striking a ball which is excessively hard and excessively heavy for the person so striking the ball are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 2,952,460 to Ellis discloses a rubber ball having a vacuum cup depending inwardly from the inside surface thereof, and a smooth plane surface on the inner side of said hollow rubber ball directly opposite the said vacuum cup, and a scratch on said plane surface for the restricted passage of air from the inside of said ball to the inside of said vacuum cup when the vacuum cup is in sealing engagement with said plane surface.

U.S. Pat. No. 3,185,476 to Fechner discloses a spherical ball including an internal resilient hand grip comprising a passageway opening from the spherical surface of said body and connected with a substantially central internal cavity for placing the hand into the cavity whereby said passageway is completely contained within the spherical body.

U.S. Pat. No. 3,980,300 to Hornsby, Jr., discloses a novelty device in the form of a color-changing amusement ball comprising a spherical body member, a transparent spherical cover concentrically surrounding the body member and spaced therefrom to define a spherical cavity, and a layer of liquid crystalline material disposed within the cavity. The liquid crystalline material is responsive to temperature changes and/or deformational stresses applied thereto so that the material changes color with a change in temperature to which the ball is exposed and/or on deformation of the ball which can be accomplished by impacting the ball against a hard surface.

U.S. Pat. No. 4,187,134 to Svub et al. discloses a molded game ball, particularly for volley-ball, hand ball and soccer is made by winding a layer of fibrous material on an inflated rubber bladder, applying a sheet of a rubber mixture with a vulcanizing agent on this layer, imprinting in a cold mold a network of fields on this layer indicating places where cover segments have to be bonded thereon so that they do not get in touch one with another on their periphery and by finally pressing this semi-product with bonded cover segments in a smooth mold at temperatures for vulcanizing.

Lastly, U.S. Pat. Nos. 4,944,363 and 5,026,054 to Osher et al. disclose a resiliently deformable toy ball which is soft and supple and provides and intriguing relaxing feeling when squeezed and which possesses a low rebound percentage due to its resiliently deformable nature. The ball has a highly plasticized PVC core which is resiliently deformable due to its highly plasticized state. The PVC core is encased in a flexible polymer shell and both the core and the flexible shell are further encased in a stretchable fabric outer cover.

In this respect, the light weight, soft feel hand ball according to the present invention substantially departs from the conventional concepts and designs of the prior art, and in so doing provides an apparatus primarily developed for the purpose of making the game of hand ball more enjoyable through the use of a ball which is lighter in weight than normal and of a softer feel.

Therefore, it can be appreciated that there exists a continuing need for new and improved light weight, soft feel hand ball which can be used for making the game of hand ball more enjoyable. In this regard, the present invention substantially fulfills this need.

SUMMARY OF THE INVENTION

In view of the foregoing disadvantages inherent in the known types of resilient balls of various designs and configurations now present in the prior art, the present invention provides an improved light weight, soft feel hand ball. As such, the general purpose of the present invention, which will be described subsequently in greater detail, is to provide a new and improved light weight, soft feel hand ball apparatus and method which has all the advantages of the prior art and none of the disadvantages.

To attain this, the present invention essentially comprises a new and improved lighter weight, softer feel handball comprising, in combination, a hollow sphere which has an inner diameter of 1.23 inches and an outer diameter of 1.88 inches and a thickness of 0.325 inches throughout its entire extent. The sphere is fabricated of an elastomeric material weighing between 50 and 60 grams with a compression between 0.170 and 0.220 with a drop rebound of 50–53 inches. The elastomeric material comprises 80 parts barytes, 73 parts Taktene 220 (a commercially available high cispolybutadine), 25 parts SMR-CV 60, 3 parts Disco Color Masterbatch (a commercially available color concentrate), 6 parts HiSil 234 LD (a commercially available precipitated hydroted amorphous silica), 5 parts zinc oxide, 1.6 parts stearic acid, 1.6 parts Agerite Superlite (a commercially available polybutadine bisphenol, an antioxidant), 3 parts titanium dioxide R-2020, 5 parts Circo Lt. Oil (naphthenic Petroleum Oil), 3.14 parts sulfur, 1.28 parts Santocure N.S. (a commercially available n-t-butyl-2-benzothiazolesulfenamide), 0.27 parts Methyl Zimate and 0.68 parts DPG.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved light weight, soft feel hand ball which has all the advantages of the prior art resilient balls and none of the disadvantages.

It is another object of the present invention to provide a new and improved light weight, soft feel hand ball which may be easily and efficiently manufactured, marketed and utilized.

It is a further object of the present invention to provide a new and improved light weight, soft feel hand ball which is of a durable and reliable construction.

An even further object of the present invention is to provide a new and improved light weight, soft feel hand ball which is susceptible of a low cost of manufacture with regard to both materials and labor, and which accordingly is then susceptible of low prices of sale to the consuming public, thereby making such resilient balls of various designs and configurations economically available to the buying public.

Still yet another object of the present invention is to provide a new and improved light weight, soft feel hand ball which provides in the apparatuses and methods of the prior art some of the advantages thereof, while simultaneously overcoming some of the disadvantages normally associated therewith.

Still another object of the present invention is to make the game of hand ball more enjoyable through the use of a ball which is lighter in weight than normal and of a softer feel.

Lastly, it is an object of the present invention to provide a new and improved ball comprising a hollow sphere which has an inner diameter of about 1.23 inches and an outer diameter of about 1.88 and a thickness of about 0.325. The sphere is fabricated of an elastomeric material weighing between about 50 and 60 grams, and a compression between about 0.170 and 0.220 and a drop rebound of about 50–53 inches.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
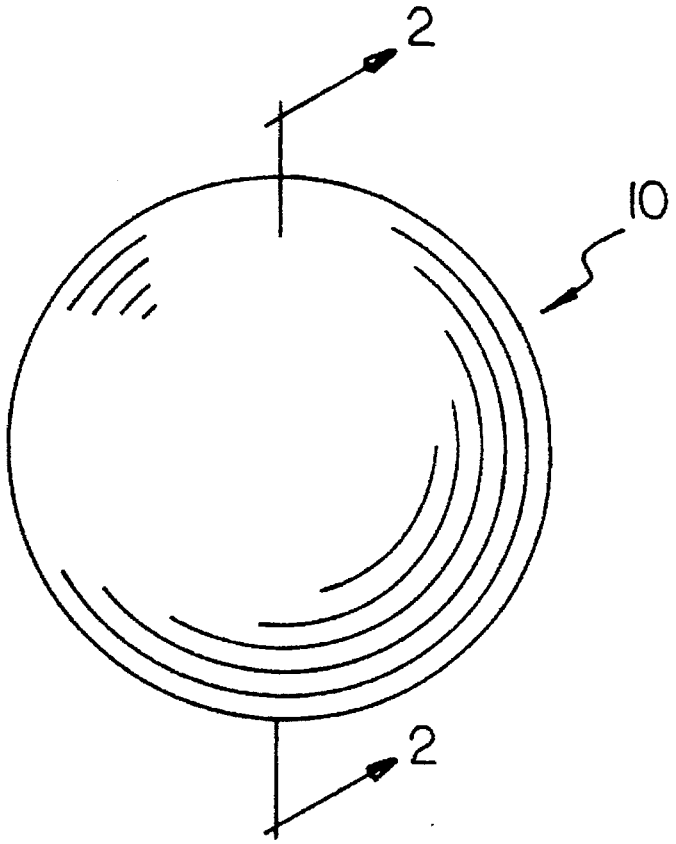
FIG. 1 is a front elevational view of the preferred embodiment of the light weight, soft feel hand ball constructed in accordance with the principles of the present invention.
Figure 2:
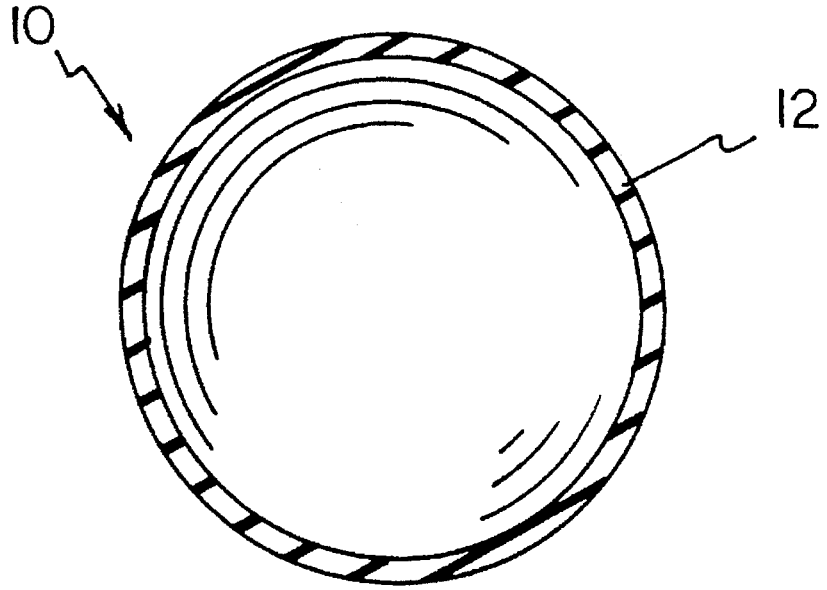
FIG. 2 is a cross sectional view through the center of the ball taken along line 2—2 of FIG. 1.

With reference now to the drawings, and in particular to FIG. 1 thereof, a new and improved light weight, soft feel hand ball embodying the principles and concepts of the present invention and generally designated by the reference numeral 10 will be described.

The present invention relates to a ball, a hand ball 10 in the preferred embodiment. Note FIG. 1. The ball is of a conventional size, about 1.88 inches in its outside diameter. Its inside diameter is about 1.23 inches while its wall thickness is about 0.325 inches. Such a size and shape is throughout the entire extent of the ball.

The hand ball is preferably fabricated of an elastic material. The material is designed to render the ball between about 50 and 59 grams in weight. In addition, the ball has a compression between about 0.170 and about 0.220. By compression it is meant the number of inches that a hand ball will deflect when a predetermined load is applied with an industry standard Stevens Machine. The drop rebound of the ball is between about 50 and 53 inches. By drop rebound it is meant the number of inches a hand ball will rebound when dropped from a height of 70 inches measuring from the bottom of the ball.

The preferred elastomeric material for the ball includes three primary components. The three primary components are about 80 parts barytes. The barytes are a weight enhancer added for the purpose of obtaining desired weight. The barytes constitute about 38 percent of the entire weight of the ball. The second major component of the ball is Taktene 220. Taktene 220 is a trademark of the Bayer corporation. The Taktene 220 constitutes about 73 parts of the weight of the ball which is about 35 percent. Taktene 220 is a rebound enhancer added for the purpose of increasing the rebound or liveliness of the ball. The third major component of the ball is rubber, preferably SMR-CV 60. SMR-CV 60 is a natural rubber from Malaysia. The SMR-CV 60 constitutes about 25 parts of the weight of the ball, about 12 percent.

The next component of the ball is Disco Color Masterbatch. Disco Color Masterbatch is a trademark of Disco Corporation. The Disco Color Masterbatch constitutes about 3 parts of the weight of the ball, about 1.4 percent. The Disco Color Masterbatch is added for the purpose of obtaining the desired color.

The next component of the ball is HiSil 234 LD. HiSil 234 LD is a trademark of PPG Industries. The HiSil 234 LD constitutes about 6 parts of the weight of the ball, about 2.8 percent. The HiSil 234 LD is added for the purpose of increasing tear strength.

The next component of the ball is stearic acid. Stearic acid is a chemical of Housmex Inc. The stearic acid constitutes about 1.6 parts of the weight of the ball, about 0.7 percent. The stearic acid is added for the purpose of activating the vulcanization.

The next component of the ball is Agerite Superlite. Agerite Superlite is a trademark of Vanderbilt Corporation, Inc. The Agerite Superlite constitutes about 1.6 parts of the weight of the ball, about 0.7 percent. The Agerite Superlite is added for the purpose of antioxidant protection.

The next component of the ball is titanium dioxide R-2020. Titanium dioxide R-2020 is a chemical of Kronos, Inc. The titanium dioxide R-2020 constitutes about 3 parts of the weight of the ball, about 1.4 percent. The titanium dioxide R-2020 is added for the purpose of increasing the whiteness for coloring.

The next component of the ball is Circo Lt. Oil. Circo Lt. Oil is a trademark of Sun Refining Corporation. The Circo Lt. Oil constitutes about 5 parts of the weight of the ball, about 2.3 percent. The Circo Lt. Oil is added for the purpose of processing and softening.

The next component of the ball is sulfur. The sulfur constitutes about 3.14 parts of the weight of the ball, about 1.5 percent. The sulfur is added for the purpose of vulcanization.

The next component of the ball is Santocure N.S. Santocure N.S. is a trademark of Monsanto Corporation. The Santocure N.S. constitutes about 1.28 parts of the weight of the ball, about 0.6 percent. The Santocure N.S. is added for the purpose of accelerating vulcanization.

The next component of the ball is Methyl Zimate. The Methyl Zimate constitutes about 0.27 parts of the weight of the ball, about 0.1 percent. The Methyl Zimate is added for the purpose of accelerating vulcanization.

The next component of the ball is DPG, disphenylguanide. DPG is a chemical of Monsanto Corporation. The DPG constitutes about 0.68 parts of the weight of the ball, about 0.3 percent. The DPG is added for the purpose of accelerating vulcanization.

The playing characteristics of the ball are such that it will be of a slightly lesser weight to render it less fatiguing to the user, particularly the user's hand, when striking the ball. In addition, the materials are such as to render the ball of a softer feel when a user strikes the ball. A more comfortable play of handball is thus attained for greater enjoyment of the user, especially beginners.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A handball comprising a hollow sphere having an inner diameter of about 1.23 inches and an outer diameter of about 1.88 inches and a thickness of about 0.325 inches, the sphere being fabricated of an elastomeric material weighing between about 50 and 59 grams, and a compression between about 0.170 and 0.220 and a drop rebound of about 50–53 inches.

2. The handball as set forth in claim 1 wherein the principal components of the elastomeric material are a weight enhancer, a rebound enhancer and rubber.

3. The handball as set forth in claim 2 wherein the weight enhancer is barytes.

4. The handball as set forth in claim 2 wherein the weight enhancer is about 38.2 percent of the weight of the ball.

5. The handball as set forth in claim 2 wherein the rebound enhancer is Taktene 220.

6. The handball as set forth in claim 2 wherein the rebound enhancer is about 35.2 percent of the weight of the ball.

7. The handball as set forth in claim 2 wherein the rubber is natural rubber.

8. The handball as set forth in claim 2 wherein the rubber is about 12 percent of the weight of the ball.

9. The handball as set forth in claim 2 and further including about 1.4 percent Disco Color Masterbatch, about 2.8 percent HiSil 234 LD, about 2.3 percent zinc oxide, about 0.7 percent stearic acid, about 0.7 percent Agerite Superlite, about 1.4 percent titanium dioxide R-2020, about 2.3 percent Circo Lt. Oil, about 0.6 percent sulfur, about 0.6 percent Santocure N.S., about 0.1 percent Methyl Zimate, and about 0.3 percent DPG.

10. A handball comprising, in combination a hollow sphere fabricated of an elastomeric material comprising about 38.2 percent barytes, about 35.2 percent Taktene 220, about 12 percent SMR-CV 60, about 1.4 percent Disco Color Masterbatch, about 2.8 percent HiSil 234 LD, about 2.3 percent zinc oxide, about 0.7 percent stearic acid, about 0.7 percent Agerite Superlite, about 1.4 percent titanium dioxide R-2020, about 2.3 percent Circo Lt. Oil, about 0.6 percent sulfur, about 0.6 percent Santocure N.S., about 0.1 percent Methyl Zimate, and about 0.3 percent DPG.

11. A lighter weight, softer feel handball comprising, in combination, a hollow sphere having an inner diameter of 1.23 inches and an outer diameter of 1.88 inches and a thickness of 0.325 inches throughout its entire extent, the sphere being fabricated of an elastomeric material weighing between 50 and 60 grams with a compression between 0.170 and 0.220 with a drop rebound of 50–53 inches, the elastomeric material comprising 80 parts barytes, 73 parts Taktene 220, 25 parts SMR-CV 60, 3 parts Disco Color Masterbatch, 6 parts HiSil 234 LD, 5 parts zinc oxide, 1.6 parts stearic acid, 1.6 parts Agerite Superlite, 3 parts titanium dioxide R-2020, 5 parts Circo Lt. Oil, 3.14 parts sulfur, 1.28 parts Santocure N.S., 0.27 parts Methyl Zimate, 0.68 parts diphenylgauanide.

* * * * *